US005682869A

United States Patent [19]

Nankee, II et al.

[11] Patent Number: 5,682,869

[45] Date of Patent: Nov. 4, 1997

[54] METHOD OF CONTROLLING A VAPOR STORAGE CANISTER FOR A PURGE CONTROL SYSTEM

[75] Inventors: Robert J. Nankee, II, Canton; Richard K. Moote, Ann Arbor; Charles B. Dupuis, St. Clair Shores; Dennis A. Krozek, Canton; Shean P. Huff, Ann Arbor; Erika J. Boss, Plymouth; Danny K. Schuelke, Grass Lake, all of Mich.

[73] Assignee: Chrysler Corporation, Auburn Hills, Mich.

[21] Appl. No.: 639,604

[22] Filed: Apr. 29, 1996

[51] Int. Cl.[6] ..... F02D 41/14; F02M 25/08

[52] U.S. Cl. ..... 123/698

[58] Field of Search ..... 123/674, 675, 123/698, 518, 519, 520

[56] References Cited

U.S. PATENT DOCUMENTS

| | | | |
|---|---|---|---|
| 2,552,261 | 5/1951 | Coughlin | 417/395 |
| 3,162,132 | 12/1964 | Kling | 417/375 |
| 4,664,087 | 5/1987 | Hamburg | 123/698 |
| 4,794,790 | 1/1989 | Margarit-Metaxa et al. | 73/117.3 |
| 4,846,119 | 7/1989 | Geyer et al. | 123/73 C |
| 5,146,902 | 9/1992 | Cook et al. | 123/518 |
| 5,150,689 | 9/1992 | Yano et al. | 123/519 |
| 5,158,054 | 10/1992 | Otsuka | 123/198 D |
| 5,182,945 | 2/1993 | Setter | 73/118.1 |
| 5,187,973 | 2/1993 | Kunze et al. | 73/40.5 R |
| 5,191,870 | 3/1993 | Cook | 123/520 |
| 5,193,512 | 3/1993 | Steinbrenner et al. | 123/520 |
| 5,239,858 | 8/1993 | Rogers et al. | 73/40.7 |
| 5,245,973 | 9/1993 | Otsuka et al. | 123/518 |
| 5,263,460 | 11/1993 | Baxter et al. | 123/520 |
| 5,267,470 | 12/1993 | Cook | 73/49.7 |
| 5,275,144 | 1/1994 | Gross | 123/520 |
| 5,284,050 | 2/1994 | Iida et al. | 73/118.1 |
| 5,317,909 | 6/1994 | Yamada et al. | 73/118.1 |
| 5,383,437 | 1/1995 | Cook et al. | 123/520 |
| 5,408,866 | 4/1995 | Kawamura et al. | 73/40 |
| 5,411,004 | 5/1995 | Busato et al. | 123/520 |
| 5,465,703 | 11/1995 | Abe | 123/674 |
| 5,495,749 | 3/1996 | Dawson et al. | 73/49.7 |
| 5,499,614 | 3/1996 | Busato et al. | 123/520 |
| 5,529,047 | 6/1996 | Aota et al. | 123/698 |

FOREIGN PATENT DOCUMENTS

| | | |
|---|---|---|
| 2635823 | 3/1990 | France . |
| 2681098 | 3/1993 | France . |

*Primary Examiner*—Willis R. Wolfe
*Attorney, Agent, or Firm*—Mark P. Calcaterra

[57] ABSTRACT

A method of controlling a vapor storage canister for a purge control system of an internal combustion engine is provided. The method includes the steps of determining if predetermined conditions are right for controlling a vapor storage canister and maintaining normal fuel feedback operation if the predetermined conditions are not right for controlling the vapor storage canister. The method also includes the steps of determining if the vapor storage canister is loaded if the predetermined conditions are right for controlling the vapor storage canister, maintaining normal fuel feedback operation if the vapor storage canister is not loaded and modifying a duty cycle of a purge solenoid to maximize purge if the vapor storage canister is loaded. The method further includes the steps of updating a loaded canister total purge multiplier and using the total purge multiplier to vary the amount of fuel being delivered to the internal combustion engine.

16 Claims, 11 Drawing Sheets

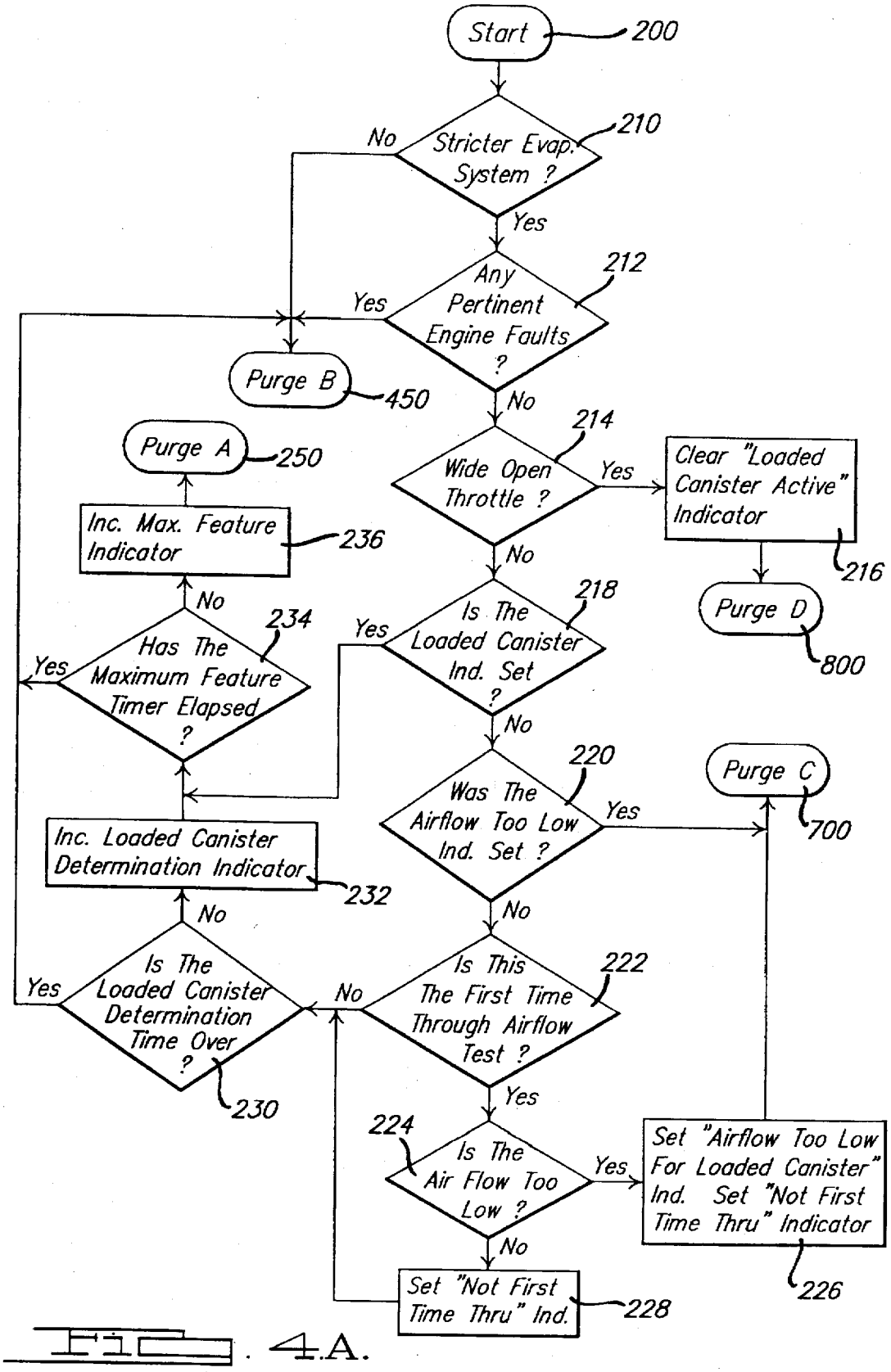
FIG. 4.A.

METHOD OF CONTROLLING A VAPOR STORAGE CANISTER FOR A PURGE CONTROL SYSTEM

BACKGROUND OF THE INVENTION

1. Field of the Invention

The present invention relates generally to a purge control system for an internal combustion engine and, more particularly, to a method of controlling a vapor storage canister for a purge control system of an internal combustion engine.

2. Description of the Related Art

Stricter Federal and California evaporative emission standards for automotive vehicles require that Federal Test Procedure (FTP) emission levels be measured with a loaded vapor storage canister. The standards require that the automotive vehicle undergo an FTP emission cycle, after which the vehicle is placed in a variable temperature shed and resting loss emissions are measured over a predetermined time period.

Under normal automotive vehicle operating conditions, fuel vapors present within the vehicle's fuel tank are temporarily stored inside a vapor storage canister. These devices are known in the art as purge canisters or vapor storage canisters. A typical vapor storage canister contains a quantity of activated charcoal as the preferred medium for storing the fuel vapors. The storage capacity of the vapor storage canister is limited by the volume of charcoal after becoming saturated with absorbed fuel vapor. Therefore, it is necessary to purge the vapor storage canister with fresh air to remove the fuel vapor and restore the storage potential of the canister.

Typically, a purge control system is used to purge the vapor storage canister. The purge control system includes a purge solenoid which is turned ON and OFF to control fuel vapor purged from the vapor storage canister. An example of such a purge control system is disclosed in U.S. Pat. No. 4,821,701 to Nankee II et al. Another example of a purge control system for controlling and varying the amount of purge flow from the vapor storage canister to the internal combustion engine is disclosed in U.S. Pat. No. 5,263,460 to Baxter et al. Although these control purge systems work well, there is still a need in the art for a purge control system that minimizes the effect on FTP emission levels when testing with a loaded vapor storage canister.

SUMMARY OF TEE INVENTION

It is, therefore, one object of the present invention to provide a method of controlling a loaded vapor storage canister for a purge control system of an internal combustion engine.

It is another object of the present invention to provide a method for minimizing the effect on FTP emission levels when testing with a loaded vapor storage canister.

It is yet another object of the present invention to provide a method for maximizing the amount of purge vapors drawn from the vapor storage canister.

It is a further object of the present invention to provide a method for more quickly purging the purge vapors from the vapor storage canister.

To achieve the foregoing objects, the present invention is a method of controlling a vapor storage canister for a purge control system of an internal combustion engine. The method includes the steps of determining whether predetermined conditions are right for controlling a vapor storage canister, and maintaining normal fuel feedback operation if the predetermined conditions are not right for controlling the vapor storage canister. The method includes the steps of determining if the vapor storage canister is loaded if the predetermined conditions are right for controlling the vapor storage canister and maintaining normal fuel feedback operation if the vapor storage canister is not loaded. The method includes the steps of modifying a duty cycle of a purge solenoid to maximize purge if the vapor storage canister is loaded, updating a loaded canister total purge multiplier and using the total purge multiplier to vary the amount of fuel being delivered to the internal combustion engine.

One advantage of the present invention is that a method is provided of controlling a vapor storage canister for a purge control system of an internal combustion engine. Another advantage of the present invention is that the method varies the amount of purge flow to the internal combustion engine. Yet another advantage of the present invention is that the method allows the vapor storage canister to be cleaned more quickly. Still another advantage of the present invention is that the method allows for a reduction in vapor storage canister weight. A further advantage of the present invention is that the method allows for improved fuel\air control of the internal combustion engine after the vapor storage canister is sufficiently purged.

Other objects, features and advantages of the present invention will be readily appreciated as the same becomes better understood after reading the subsequent description taken in conjunction with the accompanying drawings.

BRIEF DESCRIPTION OF THE DRAWINGS

FIGS. 4A through 4K are detailed flowcharts of the method of FIG. 3.

DESCRIPTION OF THE PREFERRED EMBODIMENT(S)

Figure 1:
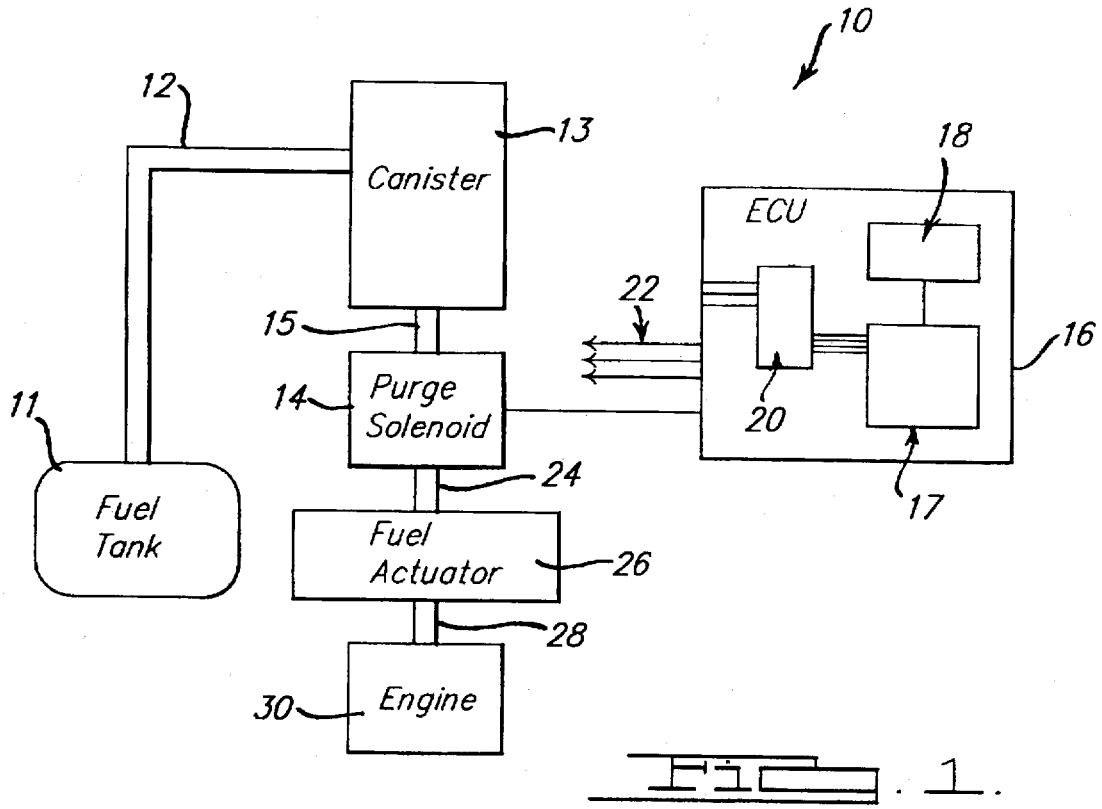
FIG. 1 is a schematic diagram of a purge control system for an internal combustion engine of an automotive vehicle.

Referring to FIG. 1, a purge control system, is generally shown at 10, for an internal combustion engine 30 of an automotive vehicle (not shown). The purge control system 10 includes a fuel tank 11 connected by a conduit 12 to a purge or vapor storage canister 13. Under normal operating conditions, fuel vapors form in the fuel tank 11 and are directed through the conduit 12 into vapor storage canister 13. The purge control system 10 also includes a purge solenoid 14 connected by a conduit 15 to the vapor storage canister 13. The purge control system 10 further includes an Electronic Control Unit (ECU) 16 which controls the flow (ON or OFF) of the purge solenoid 14. The ECU 12 includes a Microprocessing Unit 17, memory 18, Input/Output module 20, communication lines 22, and other hardware and software necessary to control tasks of engine control such as fuel to air ratios, fuel spark timing, or exhaust gas recirculation. When the ECU 16 turns the purge solenoid 14 ON, fuel vapor is purged from the vapor storage canister 13 and through a conduit 24 and into a fuel actuator 26. The fuel actuator 26 delivers a mixture of fuel and vapors through a conduit 28 to the internal combustion engine 30. It should be appreciated that the purge control system 10 may include other sensors, transducers or the like in communication with the ECU 16 to carry out the method to be described. It should also be appreciated that the purge control system 10 may be similar to that disclosed in U.S. Pat. No. 4,821,701 to Nankee II et al. and U.S. Pat. No. 5,263,460 to Baxter et al.

Figure 2:
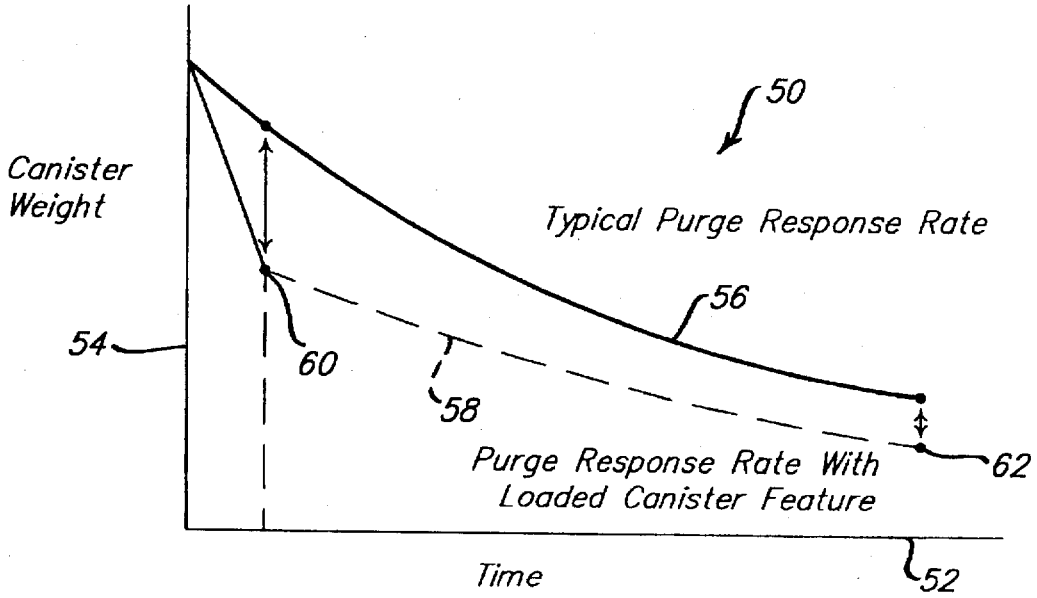
FIG. 2 is a graph of Time vs. Canister Weight for a method, according to the present invention, of controlling a vapor storage canister for the purge control system of FIG. 1.

Referring to FIG. 2, a graph 50 of Time vs. Canister Weight for the purge control system 10 which is operated by a method, according to the present invention, of controlling the vapor storage canister 13 is shown. The x-axis 52 represents time, and the y-axis 54 represents canister weight of the vapor storage canister 13. Line 56 illustrates a purge response rate of a typically loaded vapor storage canister 13, while line 58 illustrates a purge response rate of a loaded vapor storage canister 13 utilizing the method to be described. The benefit of the method, according to the present invention, is faster initial reduction in canister purge weight, illustrated at point 60, and the overall reduction in canister weight, illustrated at point 62.

Figure 3:
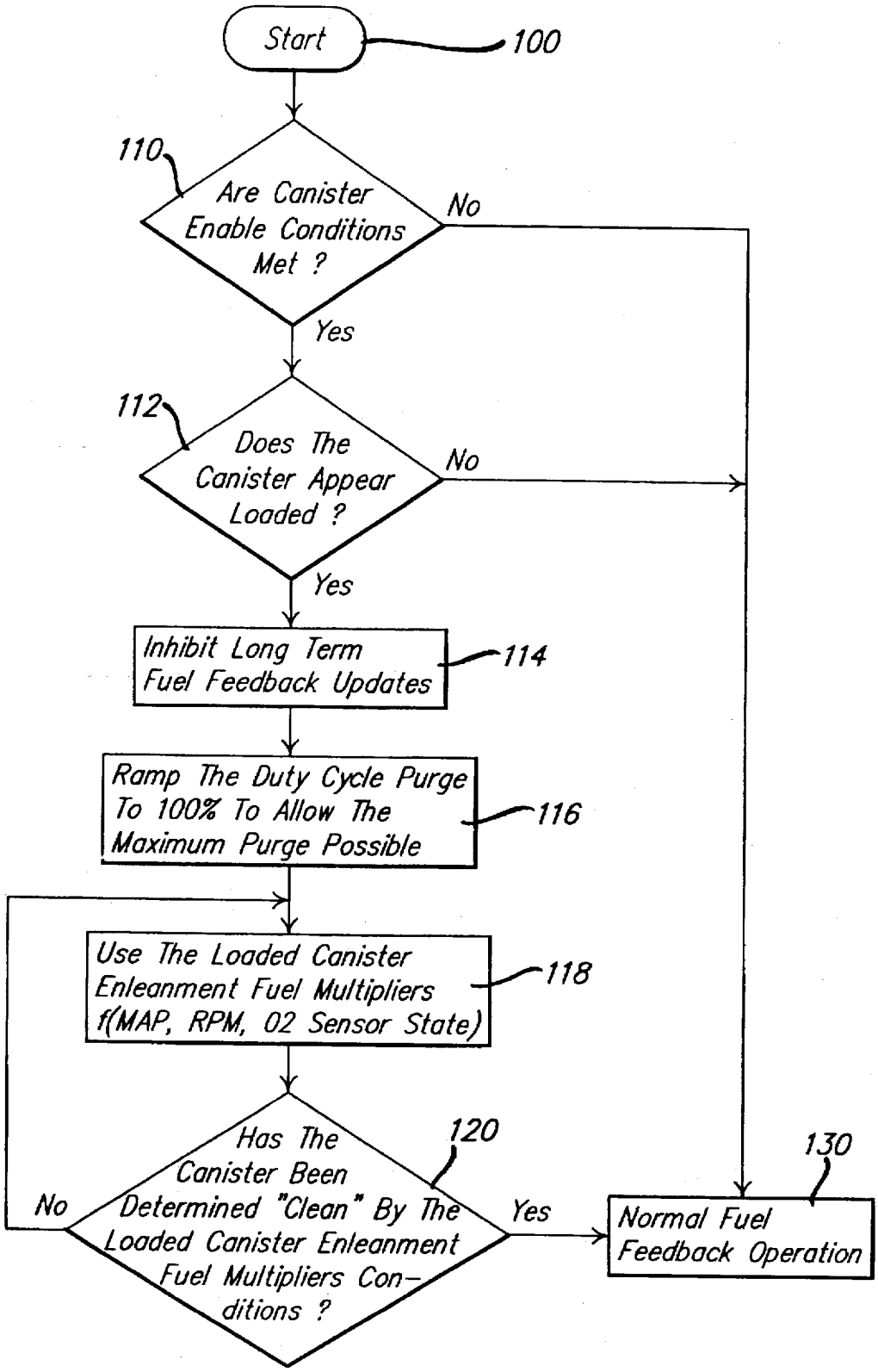
FIG. 3 is a general flowchart of a method, according to the present invention, of controlling a vapor storage canister for the purge control system of FIG. 1.

Referring to FIG. 3, a general flowchart of a method, according to the present invention, for controlling the vapor storage canister 13 for the purge control system 10 of FIG. 1 is illustrated. The methodology starts or enters at bubble 100 and advances to diamond 110. In diamond 110, the methodology determines whether canister enabling conditions are met to control the vapor storage canister 13. Examples of enabling conditions may include, but are not limited to: determining if an indicator such as a flag is set because the vehicle is required to meet stricter evaporative emission standards; whether the start-up coolant temperature of the engine 30 is greater than a predetermined temperature; or if the airflow of the engine 30 is above a predetermined value.

If enabling conditions have not been met, the methodology advances to block 130 to be described. If the enabling conditions are met, the methodology advances to diamond 112 and determines whether the vapor storage canister 13 appears loaded. For example, the ECU 16 determines that the vapor storage canister 13 is loaded if an average short term fuel feedback before the purge solenoid 14 is turned ON minus an average short term feedback after the purge solenoid 14 is turned ON is greater than or equal to a predetermined fuel shift delta. If this value is not greater than a fuel shift delta, the vapor canister 13 is not loaded and the methodology advances to block 130 to be described.

If the value is greater than the fuel shift delta, the vapor storage canister 13 is loaded and the methodology advances to block 114. In block 114, the methodology inhibits long term fuel feedback value updates. The methodology then advances to block 116 and ramps a duty cycle of the purge solenoid 14 to 100% to allow the maximum purge possible, before advancing to block 118. In block 118, the methodology stores loaded canister enleanment multipliers in the ECU 16 until called for by an oxygen (O2) controller (not shown).

After block 118, the methodology advances to diamond 120 and determines whether the vapor storage canister 13 is "clean" by the loaded canister enleanment fuel multipliers. For example, the methodology determines if a condition is right to disable the loaded canister feature. For example, a condition may include whether an average short term fuel feedback before the purge solenoid 14 is turned ON minus an average short term feedback after the purge solenoid 14 is turned ON is less than a predetermined delta, if the loaded canister maximum on time is reached. If the condition is not right, the methodology branches back to block 118 previously described. If the condition is right, the methodology branches to block 130. In block 130, the methodology ends and normal fuel feedback operation is resumed.

Figure 4B:
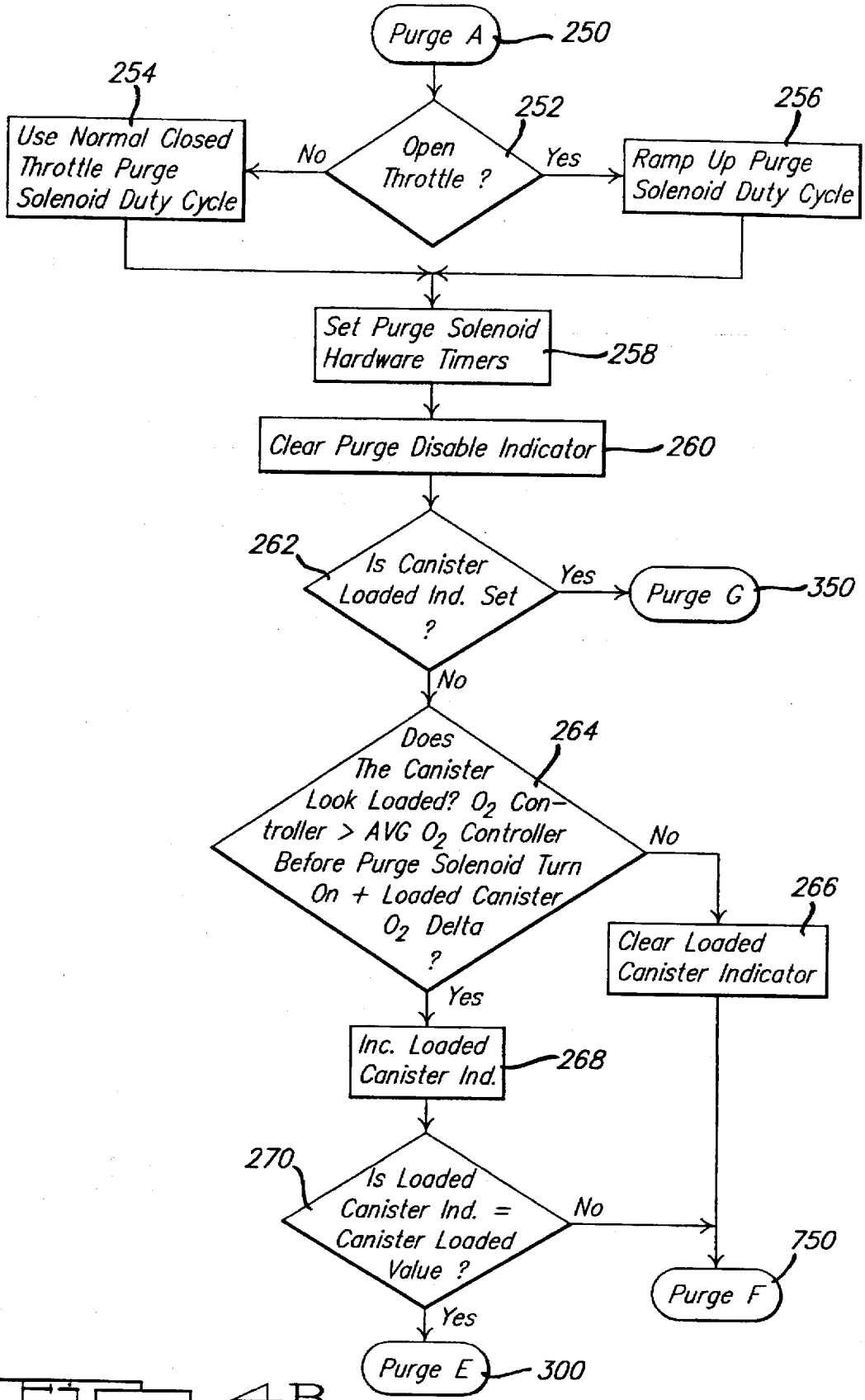

Referring to FIGS. 4A through 4K, detailed flowcharts of the method, according to the present invention, of FIG. 3 of controlling the vapor storage canister 13 for the purge control system 10 is described. In FIG. 4A, enabling conditions for controlling the purge control system 10 are checked. The methodology begins in bubble 200 after being called for by the ECU 16 and continues to diamond 210. In diamond 210, methodology determines if a stricter emission standard indicator such as a flag, is set because the vehicle must comply with stricter evaporative emission standards. If the stricter evaporative emission standard indicator is not set, the methodology advances to bubble 450 to be described in FIG. 4F.

If the stricter evaporator emission standard indicator is set, the methodology advances to diamond 212. In diamond 212, the methodology determines whether there are any pertinent engine faults such as a purge flow solenoid, etc. If there are pertinent engine faults, the methodology advances to bubble 450 to be described. If there are not pertinent engine faults, the methodology advances to diamond 214 and determines if the engine 30 is operating at wide open throttle. If the engine 30 is operating at wide open throttle, the methodology advances to block 216 and clears a loaded canister active indicator, such as a flag, before proceeding to bubble 800 to be described in FIG. 4K.

In diamond 214, if the engine 30 is not at wide open throttle, the methodology advances to block 218 and determines if a loaded canister active indicator is set. If the loaded canister active indicator is set, the methodology advances to diamond 234 to be described. If the loaded canister active indicator is not set, the methodology advances to block 220 and determines if an engine airflow too low indicator, such as a flag, is set. It should be appreciated that the engine airflow is important because it is easier to determine if the vapor storage canister 13 is loaded if the engine airflow is above a certain value.

Figure 4C:
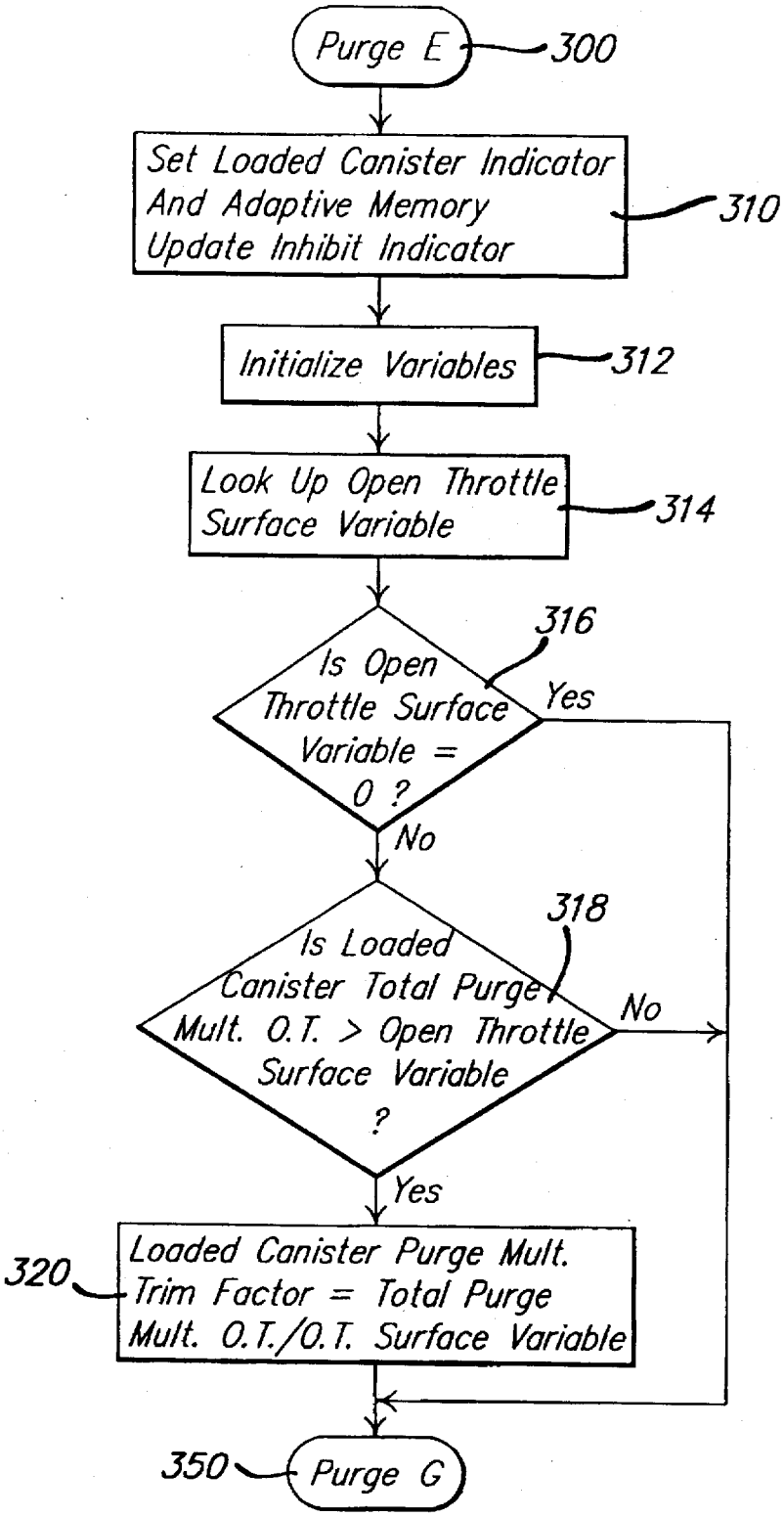
Figure 4D:
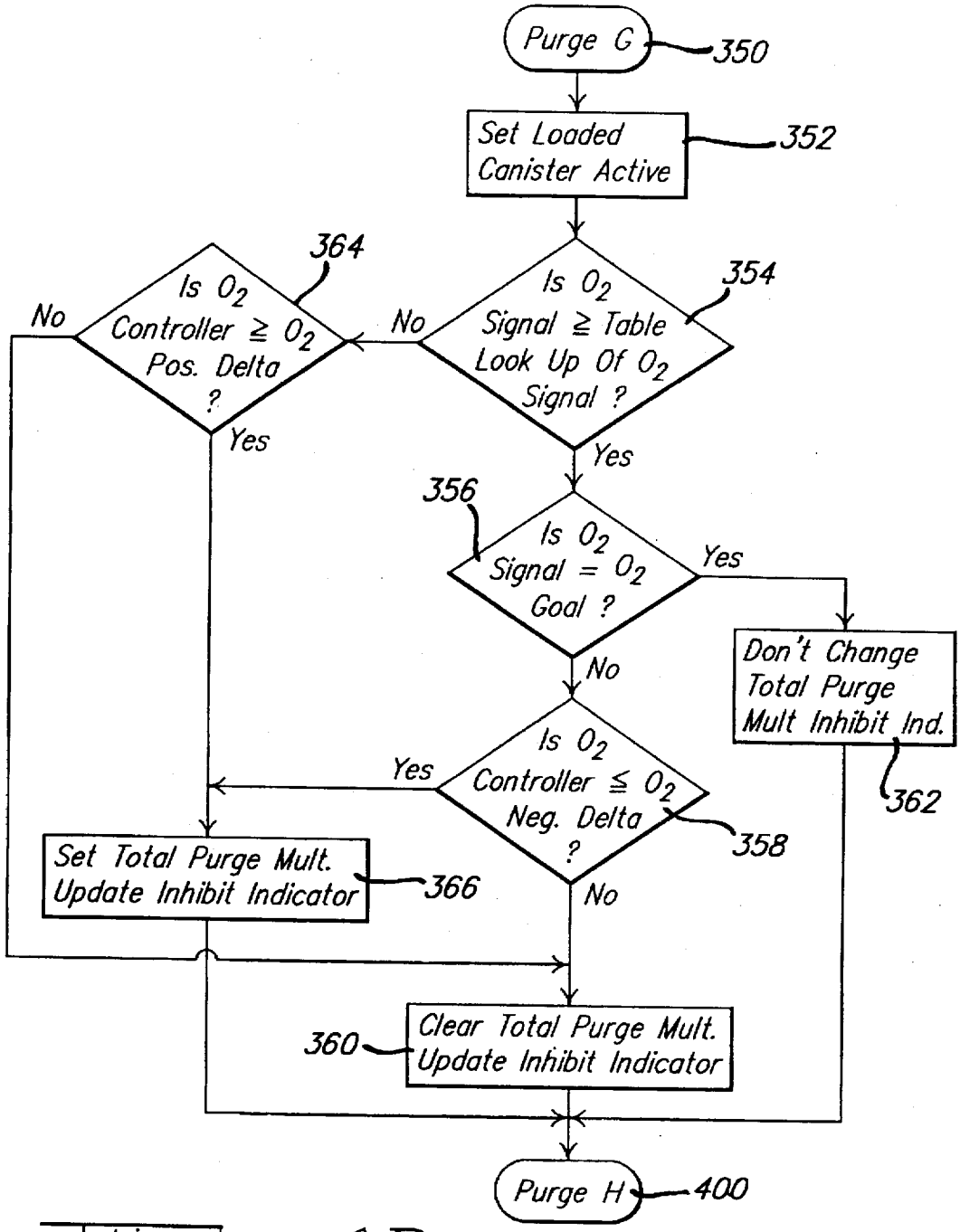
Figure 4E:
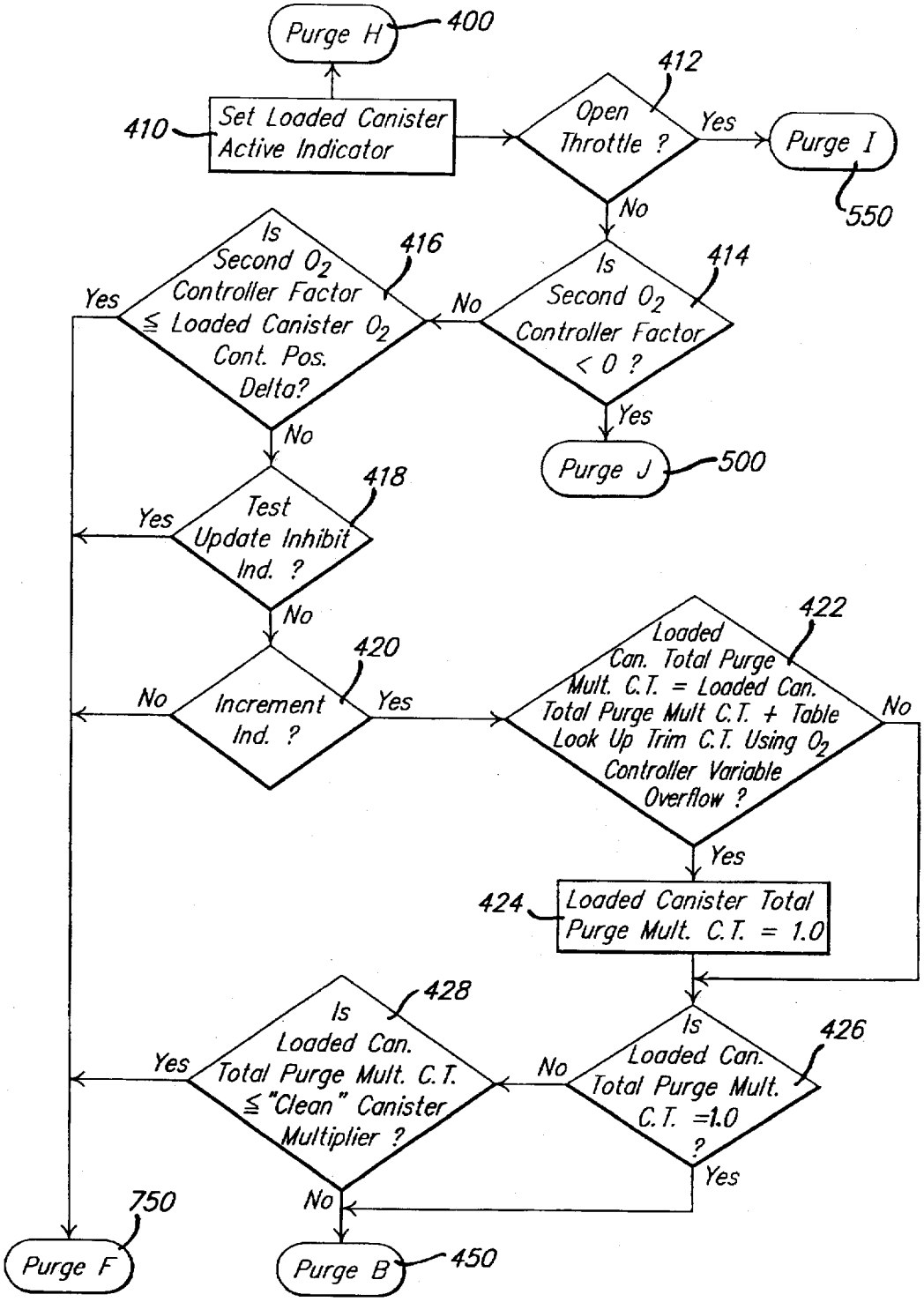
Figure 4F:
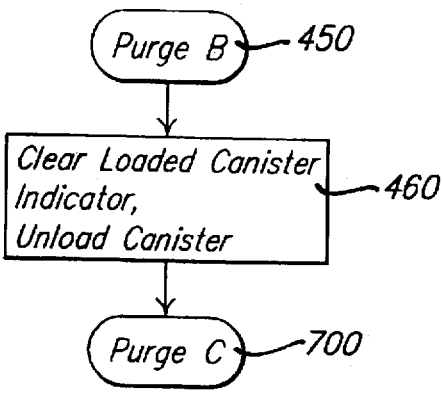
Figure 4G:
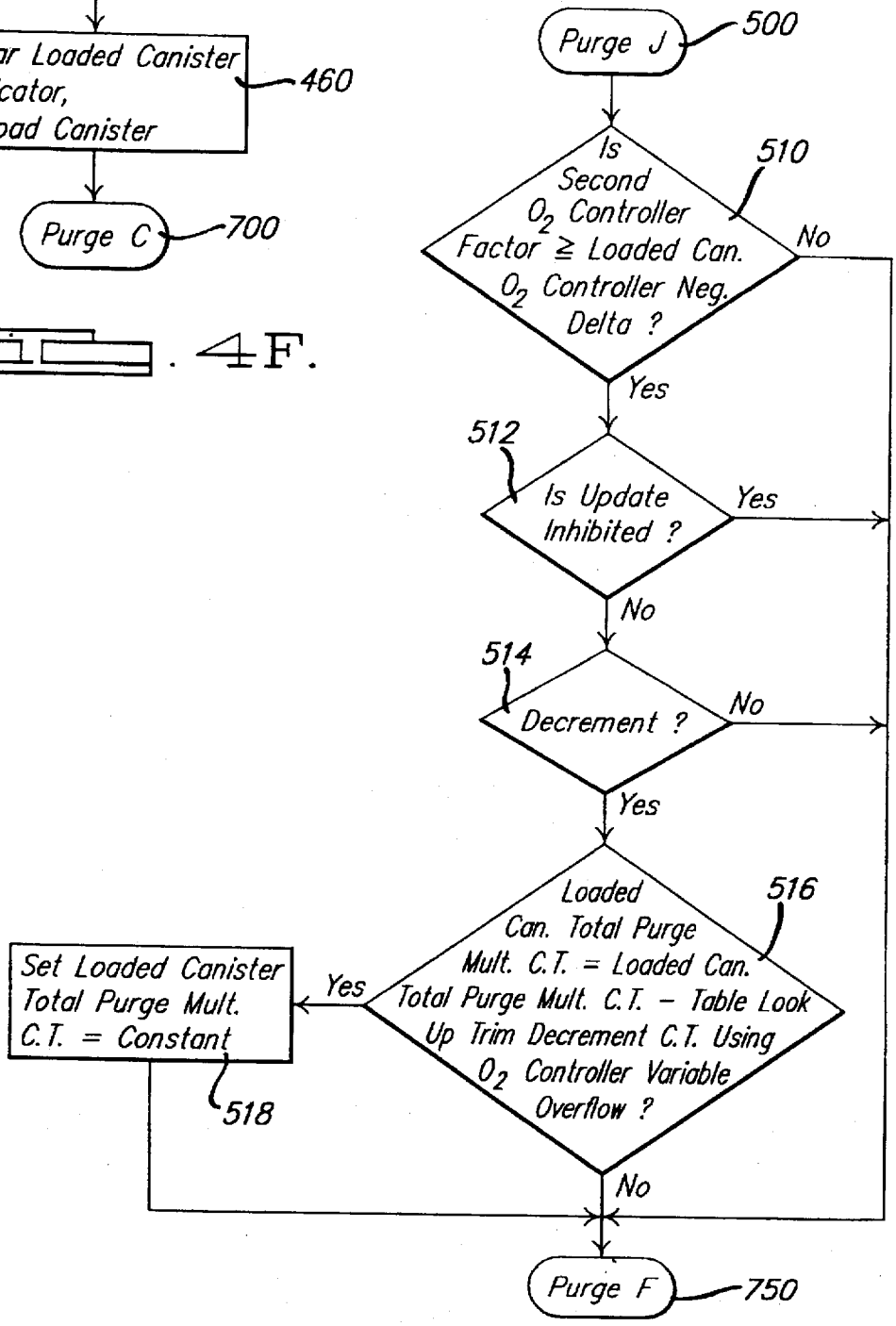
Figure 4H:
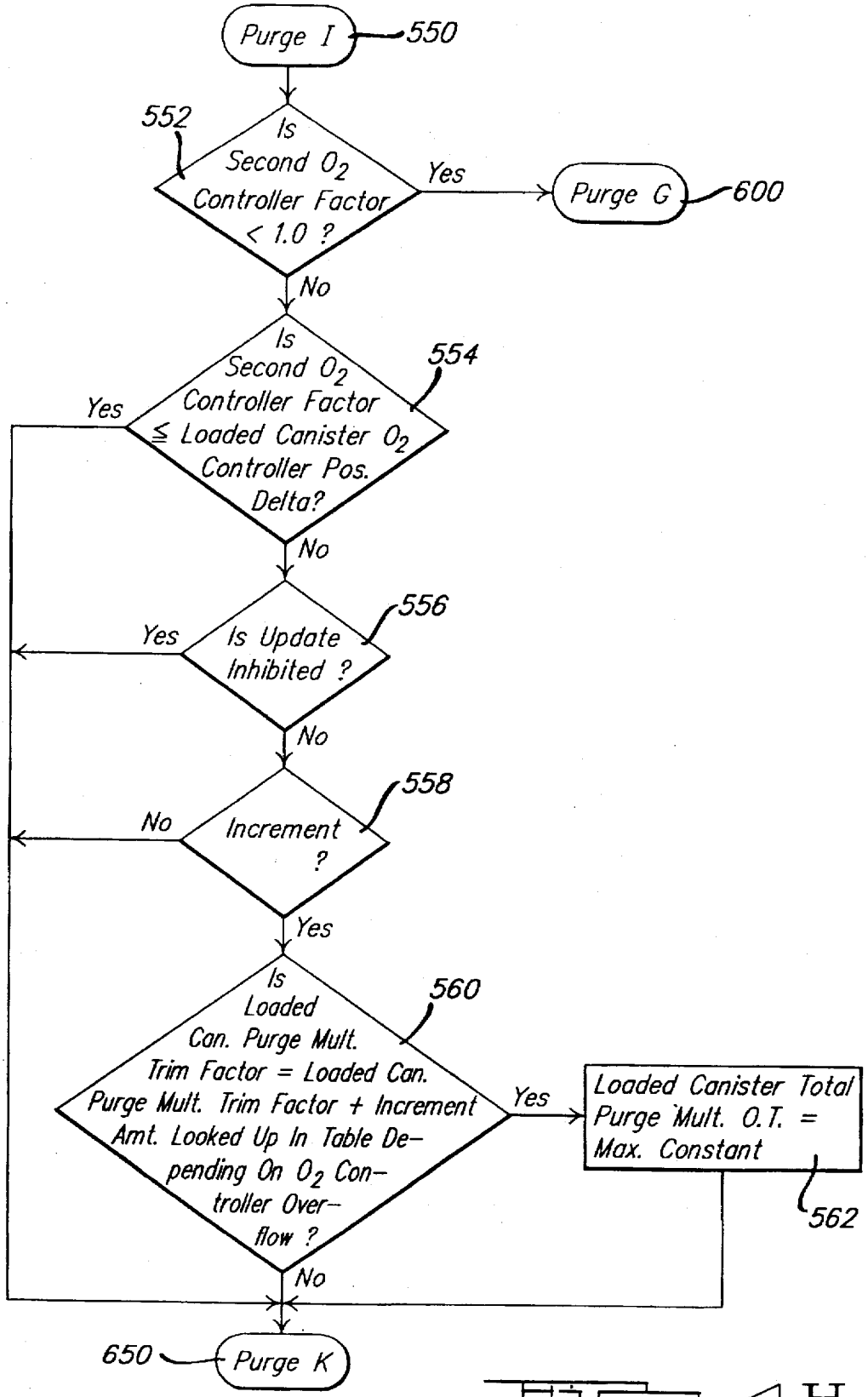
Figure 4I:
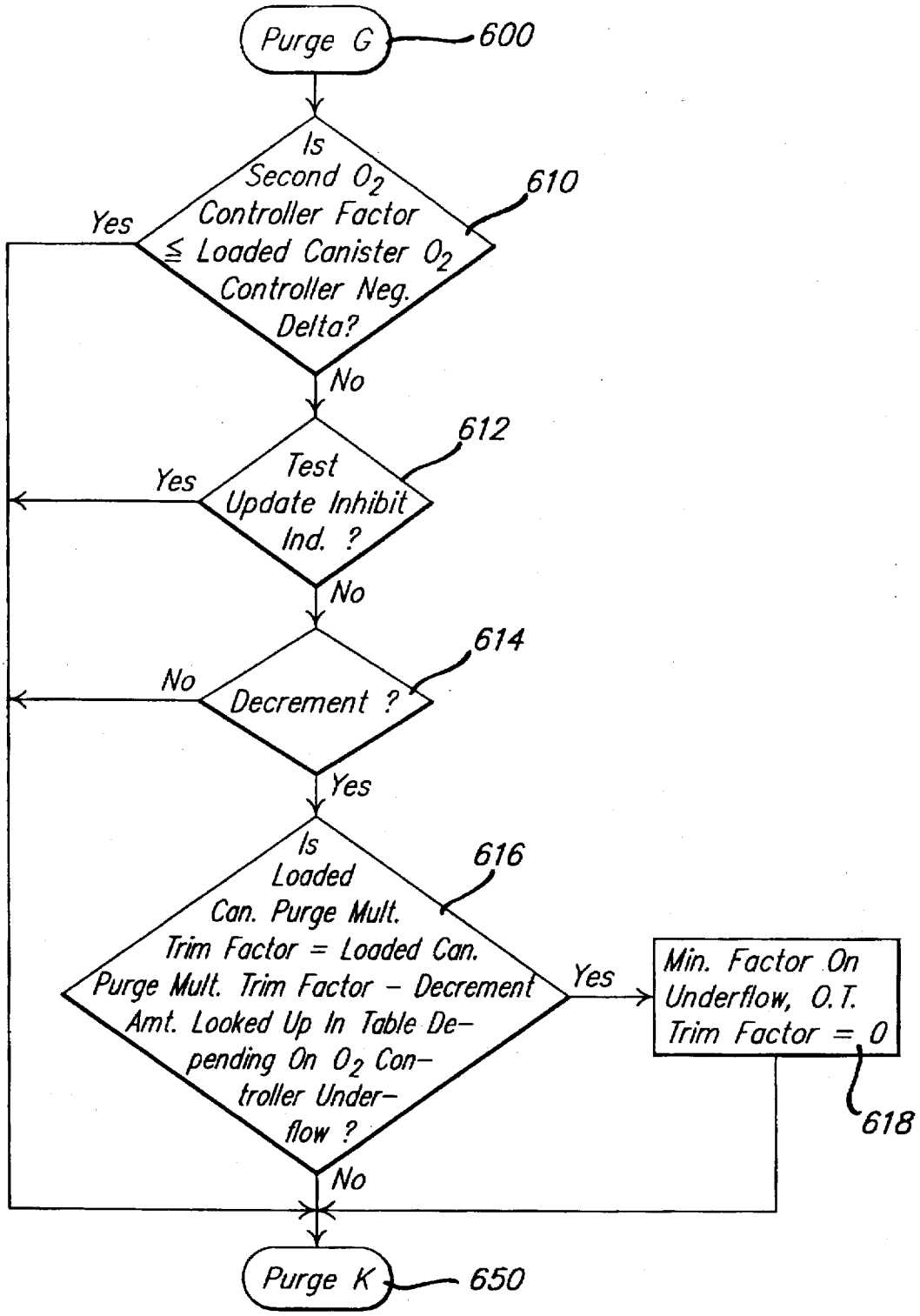
Figures 4J, 4K:
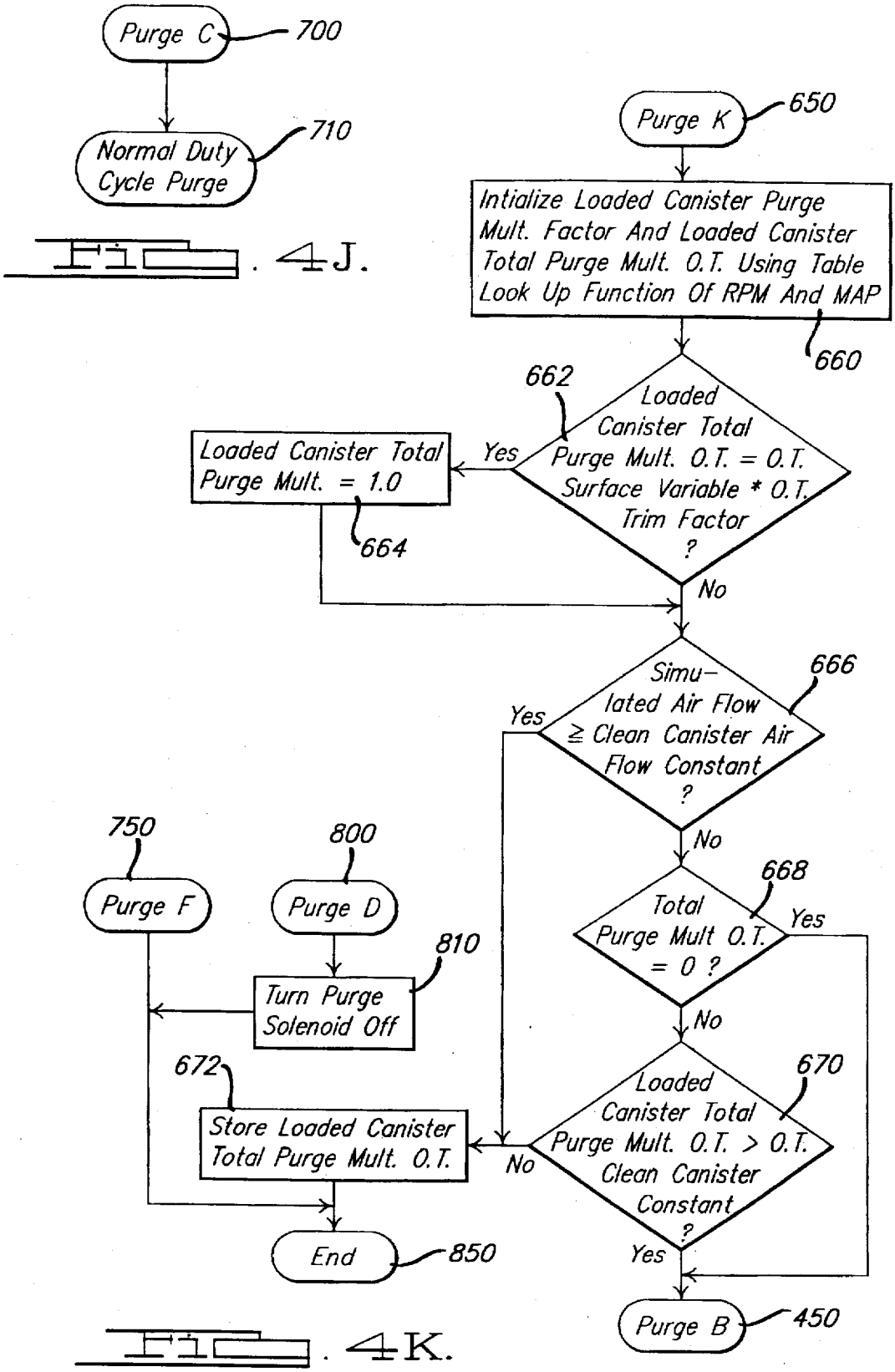

If the engine airflow too low indicator is set, the methodology advances to bubble 700 to be described in FIG. 4J. If the engine airflow too low indicator is not set, the methodology continues to diamond 222. In diamond 222, the methodology determines if this is the first time through the airflow test, for example, by looking for an indicator such as a flag. If this is not the first time through the airflow test, the methodology advances to diamond 230 to be described.

If this is the first time through the airflow test, the methodology advances to diamond 224. In diamond 224, the methodology determines if the engine airflow is too low by looking for the engine airflow too low indictor. If the engine airflow is too low, the methodology advances to block 226 and sets the engine airflow is too low for a loaded canister indicator and not the first time through airflow test indicator. The methodology then advances to bubble 700 to be described in FIG. 4J.

If the engine airflow is not too low, the methodology advances to block 228 and sets a not first time through airflow test indicator before advancing to diamond 230. In diamond 230, the methodology determines whether the loaded canister determination time is over, for example, by looking for an indicator. If the loaded canister determination time is over, the methodology advances to bubble 450 to be described in FIG. 4F. If the loaded canister determination time is not over, the methodology advances to block 232 and increments canister determination indicator such as a timer. The methodology advances to diamond 234 and determines if a maximum feature timer has elapsed, for example, by looking for an indicator. If the maximum feature timer has elapsed, the methodology advances to bubble 450 to be described in FIG. 4F. If the maximum feature timer has not elapsed, the methodology advances to block 236 and increments the maximum feature indicator such as a timer before proceeding to bubble 250 to be described in FIG. 4B.

Referring to FIG. 4B, a method of testing for the loaded vapor storage canister 13 is illustrated. The methodology begins in bubble 250, which is continued from FIG. 4A, and advances to diamond 252. In diamond 252, the methodology determines if the engine 30 is at open throttle by a signal from a throttle position sensor (not shown). If the engine 30 is not at open throttle, the methodology advances to block 254 and uses a typical or normal closed throttle purge solenoid duty cycle stored in memory 18 for the purge solenoid 14 before advancing to block 258 to be described.

If the engine is operating at open throttle, the methodology advances to block 256 and ramps up the purge solenoid duty cycle for the purge solenoid 14 before continuing to block 258. In block 258, the methodology sets a purge solenoid hardware timers in the ECU 16 for operating the purge solenoid 14. The methodology then advances to block 260 and clears a purge disable indicator. The methodology advances to diamond 262 and determines whether the canister loaded indicator is set. If the canister loaded indicator is set, the methodology advances to bubble 350 to be described in FIG. 4D.

If the canister loaded indicator is not set, the methodology advances to diamond 264 and determines whether the vapor storage canister 13 is loaded, for example, by determining if the signal from the short term fuel feedback multiplier (O2 controller) is greater than an average of the O2 controller signal before the purge solenoid 14 is turned ON plus a loaded canister O2 delta. If the vapor storage canister 13 is not loaded, the methodology advances to block 266 and clears the loaded canister indicator, before continuing to bubble 750, described in FIG. 4K. If the vapor storage canister 13 is loaded, the methodology advances to block 268 and increments the loaded canister indicator before proceeding to diamond 270. In diamond 270, the methodology determines if the loaded canister indicator is equal to a predetermined canister loaded value stored in memory 18. If the loaded canister indictor is not equal to the canister loaded value, the methodology advances to bubble 750 to be described in FIG. 4K. If the loaded canister indicator is equal to the canister loaded value, the methodology advances to bubble 300 to be described in FIG. 4C.

Referring to FIG. 4C, a method of initializing of variables is illustrated. The methodology begins in bubble 300, which is continued from FIG. 4B and advances to block 310. In block 310, the methodology sets the loaded canister indicator and an adaptive memory update inhibit indicator. The methodology then advances to block 312 and initializes variables such as the total purge multiplier. The methodology advances to block 314 and looks up an open throttle surface variable. It should be appreciated that the open throttle surface variable is taken from a table stored in memory 18, and in this example is a function of RPM and manifold absolute pressure.

After block 314, the methodology advances to diamond 316 and determines whether the open throttle surface variable is equal to a predetermined constant, which in this particular example is zero, stored in memory 18. If the open throttle surface variable is equal to zero, the methodology advances to bubble 350 to be described in FIG. 4D. If the open throttle surface variable is not equal to zero, the methodology advances to diamond 318 and determines if the loaded canister total purge multiplier open throttle is greater than the open throttle surface variable. If the loaded canister total purge multiplier open throttle is not greater, the methodology advances to bubble 350 to be described in FIG. 4D. If the loaded canister total purge multiplier is greater, the methodology advances to block 320. In block 320, the methodology calculates a loaded canister purge multiplier trim factor, for example, by dividing the total purge multiplier open throttle by the open throttle surface variable. The methodology then advances to block 350 which is described in FIG. 4D.

Referring to FIG. 4D, a method of updating the total purge multiplier is illustrated. The methodology begins in bubble 350, which is continued from FIG. 4C, and advances to block 352. In block 352, the methodology sets a loaded canister active indicator and the methodology advances to block 354. In block 354, the methodology determines if the actual O2 signal is greater than or equal to an O2 signal value taken from a table stored in memory 18. If the actual O2 signal is greater, the methodology advances to diamond 356. In diamond 356, the methodology determines if the actual O2 signal is equal to an O2 signal goal stored in memory 18. If so, the methodology advances to block 362 and doesn't change a total purge multiplier update inhibit bit in the ECU 16 before proceeding to bubble 400 to be described in FIG. 4E.

Referring back to diamond 356, if the actual O2 signal is not equal to the O2 signal goal, the methodology advances to diamond 358. In diamond 358, the methodology determines whether the O2 controller factor is less than or equal to an O2 negative delta. If the O2 controller factor is not less than or equal to the O2 negative delta, the methodology advances to block 360 and clears the total purge multiplier update inhibit bit in the ECU 16. The methodology then advances to bubble 400 to be described in FIG. 4E.

In diamond 358, if the O2 controller factor is less than or equal to the O2 negative delta, the methodology advances to block 366 and sets the total purge multiplier update inhibit bit in the ECU 16. The methodology then advances to bubble 400 to be described in FIG. 4E.

Referring back to diamond 354, if the O2 signal is not greater than or equal to the O2 signal value taken from the look-up table, the methodology advances to diamond 364. In diamond 364, the methodology determines whether the O2 controller factor is greater than or equal to an O2 positive delta. If the O2 controller factor is not less than or equal to the O2 positive delta, the methodology advances to block 360, previously described. If the O2 controller factor is less than or equal to the O2 positive delta, the methodology advances to block 366 previously described.

Referring to FIG. 4E, a method of incrementing the total purge multiplier when the engine 30 is operating at closed throttle is illustrated. The methodology enters at bubble 400 and advances to block 410 and sets the loaded canister active indicator. The methodology then advances to diamond 412 and determines if the engine 30 is at open throttle as previously described. If the engine 30 is at open throttle, the methodology advances to bubble 550 to be described in FIG. 4H. If the engine 30 is not at open throttle, the methodology advances to diamond 414. In diamond 414, the methodology determines if a second O2 controller factor is less than a predetermined value, which in this example is zero, stored in memory 18. If the second O2 controller factor is less than zero, the methodology advances to bubble 500 to be described in FIG. 4G.

If the second O2 controller factor is not less than zero, the methodology advances to diamond 416 and determines whether the second O2 controller factor is less than or equal to a loaded canister O2 controller positive delta. If the second O2 controller factor is less than or equal to the loaded canister O2 controller positive delta, then the vapor storage canister 13 is sufficiently purged and the methodology advances to bubble 750 to be described in FIG. 4K. If the second O2 controller factor is not less than or equal to the loaded canister O2 controller positive delta, the methodology advances to diamond 418 and determines if an update inhibit indicator is in effect, for example, by looking for a set flag.

If the update inhibit indicator has been tested, then the vapor storage canister 13 is clean and the methodology advances to bubble 750 to be described in FIG. 4K. If the update inhibit indicator has not been tested, the methodology advances to diamond 420 and determines whether to increment a period indicator, for example, if it is time to update. If the period indicator is not to be incremented, the methodology advances to bubble 750 to be described in FIG. 4K. If the period indicator is to be incremented, the methodology advances to diamond 422 and determines if the loaded canister total purge multiplier closed throttle is equal to the loaded canister total purge multiplier closed throttle plus a delta. In this example, the delta is a table look up value of trim increment closed throttle as a function of the O2 controller variable overflow. If equal, the methodology advances to block 424 and sets the loaded canister total purge multiplier closed throttle to a predetermined constant such as 1.0 in this example. The methodology then advances to diamond 426 to be described. If not equal, the methodology advances to diamond 426.

In diamond 426, the methodology determines whether the loaded canister total purge multiplier closed throttle is equal to a predetermined constant such as one (1.0), for this example, stored in memory 18. If equal to one (1.0), the vapor storage canister 13 is loaded and the methodology advances to bubble 450 to be described in FIG. 4F. If not equal to one (1.0), the methodology advances to diamond 428 and determines whether the loaded canister total purge multiplier closed throttle is less than or equal to a "clean" canister multiplier stored in memory 18. If the loaded canister total purge multiplier closed throttle is less than or equal to the "clean" canister multiplier, the vapor storage canister 13 is sufficiently purged and the methodology advances to bubble 750 to be described in FIG. 4K. Otherwise, the vapor storage canister 13 is loaded and the methodology advances to bubble 450 to be described in FIG. 4F.

Referring to FIG. 4F, a method of purging the loaded vapor storage canister 13 is illustrated. The methodology enters at bubble 450 and advances to block 460. In block 460, the methodology clears the loaded canister indicator in the ECU 16 and the vapor storage canister 13 is declared unloaded. The methodology then advances to bubble 700 to be described in FIG. 4J.

Referring to FIG. 4G, a method of decrementing the total purge multiplier, for example when the engine is at closed throttle, is illustrated. The methodology enters at bubble 500 and advances to diamond 510. In diamond 510, the methodology determines whether the second O2 controller factor is greater than or equal to a predetermined loaded canister O2 controller negative delta stored in memory 18. If the second O2 controller factor is not greater than or equal to the loaded canister 02 controller negative delta, the methodology advances to bubble 750 to be described in FIG. 4K.

If the second O2 controller factor is greater than or equal to the loaded canister 02 controller negative delta, the methodology advances to diamond 512 and determines whether the update inhibitor is inhibited, for example, by looking for an indicator such as a flag. If the update inhibitor is inhibited, the methodology advances to bubble 750 to be described in FIG. 4K. If the update inhibitor is not inhibited, the methodology advances to block 514 and determines whether to decrement the total purge multiplier closed throttle. If the total purge multiplier closed throttle should not be decremented, the methodology advances to bubble 750 to be described in FIG. 4K. If the total purge multiplier closed throttle should be decremented, the methodology advances to diamond 516 and tests for a clean vapor storage canister 13, for example, by determining whether the loaded canister total purge multiplier closed throttle is equal to the loaded canister total purge multiplier closed throttle minus a predetermined value. In this example, the predetermined value is taken from a table stored in memory 18 of trim decrement closed throttle as a function of an O2 controller overflow variable. If the vapor storage canister 13 is clean, the methodology advances to block 518 and sets the loaded canister total purge multiplier closed throttle equal to a predetermined constant, which in this example is 0.0039, before advancing to bubble 750. If the vapor storage canister 13 is not clean, the methodology advances to bubble 750 to be described in FIG. 4K.

Referring to FIG. 4H, a method of incrementing a total purge multiplier when the engine 30 is at open throttle is illustrated. The methodology begins in bubble 550 and advances to diamond 552. In diamond 552, the methodology determines whether the second O2 controller factor is less than a predetermined value, which in this example is 1.0, stored in memory 18. If the second O2 controller factor is less than 1.0, the methodology advances to bubble 600 to be described in FIG. 4I.

If the second O2 controller factor is not less than 1.0, the methodology advances to diamond 554 and determines whether the second O2 controller factor is less than or equal to a predetermined loaded canister O2 controller positive delta stored in memory 18. If the second O2 controller factor is less than or equal to the positive delta, the methodology advances to bubble 650 to be described in FIG. 4K.

If the second O2 controller factor is not less than or equal to the positive delta, the methodology advances to diamond 556 and determines whether the update inhibitor is inhibited, for example, by looking for an indicator such as a flag. If the update inhibitor is inhibited, the methodology advances to bubble 650 to be described in FIG. 4K. If the update inhibitor is not inhibited, the methodology advances to diamond 558 and determines whether to increment the total purge multiplier, for example, by evaluating whether a loaded canister value is less than a trim calibration constant stored in memory 18. If the total purge multiplier should not be incremented, the methodology advances to bubble 650 to be described in FIG. 4K. If the total purge multiplier should be incremented, the methodology advances to diamond 560.

In diamond 560, the methodology determines whether a loaded canister purge multiplier trim factor is equal to the loaded canister purge multiplier trim factor plus an incremental value looked up in a table as a function of O2 controller overflow. If the loaded canister purge multiplier trim factor is not equal to the trim factor plus the incremental value, the methodology advances to bubble 650 to be described in FIG. 4K. If the loaded canister purge multiplier trim factor is equal to the trim factor plus the incremental value, the methodology advances to block 562 as sets the loaded canister total purge multiplier open throttle equal to a predetermined maximum constant before proceeding to bubble 650 to be described in FIG. 4K.

Referring to FIG. 4I, a method of decrementing the total purge multiplier when the engine 30 is operating open throttle is illustrated. The methodology enters at bubble 600 and advances to diamond 610. In diamond 610, the methodology determines whether the second O2 controller factor is greater than or equal to a loaded canister O2 controller negative delta. If so, the methodology advances to bubble 650 to be described in FIG. 4K. If not, the methodology advances to diamond 612.

In diamond 612, the methodology determines whether the update inhibit indicator should be tested, for example, by looking for an indicator such as a flag. If so, the methodology advances to bubble 650 to be described in FIG. 4K. If not, the methodology advances to diamond 614 and determines whether to decrement the total purge multiplier, for example, by looking at an indicator such as a timer. If the total purge multiplier is not to be decremented, the methodology advances to bubble 650 to be described in FIG. 4K. If the total purge multiplier is to be decremented, the methodology advances to diamond 616.

In diamond 616, the methodology determines whether the loaded canister purge multiplier trim factor is equal to the loaded canister purge multiplier trim factor minus a decrement amount. In this example, the decrement amount is looked up from a table stored in memory 18 of open throttle trim decrement as a function of O2 controller underflow. If equal, the methodology advances to bubble 650 to be described in FIG. 4K. If not equal, the methodology advances to block 618 and sets the minimum factor on underflow open throttle trim factor equal to a minimum factor in underflow, which in this example is zero. The methodology then advances to bubble 650 to be described in FIG. 4K.

Referring to FIG. 4J, a method of resuming normal purge activity is illustrated. The methodology enters from bubble 700 and advances to bubble 710 where typical duty cycle control of the purge solenoid 14 is resumed because the vapor storage canister 13 is clean. It should be appreciated that the typical duty cycle of the purge solenoid 14 is stored in memory 18.

Referring to FIG. 4K, a method of checking for a clean vapor storage canister 13 under open throttle conditions is illustrated. The methodology enters at bubble 650 and advances to block 660. In block 660, the methodology initializes the loaded canister purge multiplier factor and loaded canister total purge multiplier factor. In this example, the initialized value is taken from table stored in memory 18 as a function of RPM and manifold absolute pressure (MAP).

After block 660, the methodology advances to diamond 662 and determines whether the loaded canister total purge multiplier open throttle is equal to the open throttle surface variable multiplier multiplied by the open throttle trim factor. If equal, the methodology advances to block 664 and sets the loaded canister total purge multiplier equal to a constant, which in this example is 1.0, before continuing to diamond 666. If not equal, the methodology advances to diamond 666 and tests for a clean vapor storage canister 13 by determining if a simulated air flow is greater than or equal to a clean canister airflow constant stored in memory 18. If so, the methodology advances to block 672 to be described. If not, the methodology advances to diamond 668. In diamond 668, the methodology determines whether the total purge multiplier open throttle is equal to a predetermined constant, in this example zero (0), stored in memory 18. If the total purge multiplier open throttle is equal to zero, the methodology advances to bubble 450 of FIG. 4F, previously described, to unload or clean the vapor storage canister 13.

If the total purge multiplier open throttle is not equal to zero, the methodology advances to diamond 670 and determines whether the loaded canister total purge multiplier open throttle is greater than the open throttle clean canister constant stored in memory 18. If the loaded canister total purge multiplier is greater than the open throttle clean canister constant, the methodology advances to block 450 of FIG. 4F, previously described, to unload or clean the vapor storage canister 13. If the loaded canister total purge multiplier is not greater than the open throttle clean canister constant, then the vapor storage canister 13 is clean, and the methodology advances to block 672. In block 672, the methodology stores the loaded canister total purge multiplier open throttle in the memory 18 of the ECU 16 until called for. The methodology then advances to block 850, where the methodology ends, returning control back to the ECU 16.

The methodology may also enter at bubble 750 if it was previously determined that the vapor storage canister 13 is clean, and continue to bubble 850, previously described.

The methodology may also enter at bubble 800 and advance to block 810. In block 810, the methodology turns the purge solenoid 14 OFF. The methodology then advances to bubble 850 previously described.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of controlling a vapor storage canister for a purge control system of an internal combustion engine, said method comprising the steps of:

determining whether predetermined conditions are right for controlling a vapor storage canister;

maintaining normal fuel feedback operation if the predetermined conditions are not right for controlling the vapor storage canister;

determining if the vapor storage canister is loaded if predetermined conditions are right for controlling the vapor storage canister;

maintaining normal fuel feedback operation if the vapor storage canister is loaded;

modifying a duty cycle of a purge solenoid to maximize purge if the vapor storage canister is loaded;

updating a loaded canister total purge multiplier; and using the total purge multiplier to vary the amount of fuel being delivered to the internal combustion engine.

2. A method as set forth in claim 1 wherein said step of determining whether predetermined conditions are right comprises:

determining whether the vehicle must comply with a stricter evaporative emission standard; and ending said method if the vehicle does not have to comply with the stricter evaporative emission standard.

3. A method as set forth in claim 1 wherein said step of determining whether predetermined conditions are right comprises:

determining if an actual engine airflow is greater than a predetermined airflow value; and ending said method if the actual engine airflow is not greater than the predetermined airflow value.

4. A method as set forth in claim 1 wherein said step of determining whether predetermined conditions are right comprises:

determining whether the engine is operating at wide open throttle; and turning the purge solenoid OFF if the engine is operating at wide open throttle.

5. A method as set forth in claim 1 wherein said step of determining if the vapor storage canister is loaded comprises:

activating a purge solenoid;

determining if an instantaneous oxygen (O2) controller signal minus an average O2 controller signal before the purge solenoid is turned ON is greater than a predetermined fuel shift value; and ending said method if the instantaneous O2 controller signal minus the average O2 controller signal is not greater than the predetermined fuel shift value indicating the canister is not loaded.

6. A method as set forth in claim 5 wherein said step of activating the purge solenoid comprises:

determining if the engine is operating open throttle;

using a closed throttle purge solenoid duty cycle if the engine is not operating at open throttle; and ramping up the purge solenoid duty cycle up to a first predetermined level if the engine is operating at open throttle.

7. A method as set forth in claim 1 including the step of setting a total purge multiplier equal to an initial value prior to the step of updating.

8. A method as set forth in claim 1 wherein the step of modifying the duty cycle of the purge solenoid comprises:

determining if the engine is operating at closed throttle; and fixing the duty cycle purge solenoid at a first predetermined level if the engine is operating at closed throttle.

9. A method as set forth in claim 1 wherein said step of modifying the duty cycle of the purge solenoid comprises:

determining if the engine is operating at part throttle; and ramping the duty cycle purge solenoid up to a second predetermined level if the engine is not operating at port throttle.

10. A method as set forth in claim 1 wherein said step of updating a loaded canister total purge multiplier comprises incrementing or decrementing said total purge multiplier.

11. A method as set forth in claim 10 wherein said step of incrementing comprises:

checking if the engine is operating at open throttle;

determining if a closed throttle second O2 controller factor is less than a predetermined positive delta if the engine is not operating at open throttle;

incrementing the total purge multiplier if the closed throttle second O2 controller factor is not less than the positive delta;

checking if the vapor storage canister is clean;

ending said method if the vapor storage canister is clean; and purging the vapor storage canister if the vapor storage canister is not clean.

12. A method as set forth in claim 10 wherein said step of incrementing comprises:

checking if the engine is operating at open throttle;

determining if a closed throttle second O2 controller factor is less than a predetermined negative delta if the engine is not operating at open throttle;

decrementing the total purge multiplier if the closed throttle second O2 controller factor is less than the negative delta;

checking if the vapor storage canister is clean;

setting the total purge multiplier equal to a predetermined limit if the vapor storage canister is not clean.

13. A method as set forth in claim 10 wherein said step of incrementing comprises:

checking if the engine is operating at open throttle;

determining if an open throttle second O2 controller factor is less than a predetermined positive delta if the engine is operating at open throttle;

incrementing the total purge multiplier if the open throttle second O2 controller factor is not less than the positive delta;

checking if the vapor storage canister is clean;

purging the vapor storage canister if not clean; and ending said method if the vapor storage canister is clean.

14. A method as set forth in claim 10 wherein said step of incrementing comprises:

checking if the engine is operating at open throttle;

determining if an open throttle second O2 controller factor is less than a predetermined negative delta if the engine is operating at open throttle;

decrementing the total purge multiplier if the open throttle second O2 controller factor is less than the negative delta;

checking if the vapor storage canister is clean;

purging the vapor storage canister if not clean; and setting the total purge multiplier equal to a predetermined constant if the vapor storage canister is not clean.

15. A method as set forth in claim 1 including the step of:

checking if the vapor storage canister is clean;

continuing updating the total purge multiplier and modifying the duty cycle of the purge solenoid if the vapor storage canister is not clean; and resuming normal feedback fuel control if the vapor storage canister is clean.

16. A method of controlling a vapor storage canister for a purge control system of an internal combustion engine, said method comprising the steps of:

determining whether predetermined conditions are right for controlling a potentially loaded vapor storage canister;

maintaining normal fuel feedback operation if predetermined conditions are not right for controlling the vapor storage canister;

determining if the vapor storage canister is loaded by activating the purge solenoid if predetermined conditions are right for controlling the vapor storage canister;

comparing whether an instantaneous oxygen (O2) controller signal minus an average O2 controller signal before the purge solenoid is turned on is greater than a predetermined fuel shift value;

maintaining normal fuel feedback operation if the instantaneous O2 controller signal minus the average O2 controller signal is not greater than the fuel shift value indicating the vapor storage canister is not loaded;

ramping the purge solenoid duty cycle up to maximize purge if the vapor storage canister is loaded;

incrementing or decrementing a total purge multiplier; and using said total purge multiplier to vary the amount of fuel being delivered to the engine.

* * * * *